US012152293B2

(12) United States Patent
Suzuki et al.

(10) Patent No.: US 12,152,293 B2
(45) Date of Patent: Nov. 26, 2024

(54) NIOBIUM-BASED ALLOY STRENGTHENED BY SILICIDE AND TURBINE HAVING TURBINE COMPONENT FORMED FROM

(71) Applicant: General Electric Company, Schenectady, NY (US)

(72) Inventors: Akane Suzuki, Ballston Spa, NY (US); Bernard Patrick Bewlay, Niskayuna, NY (US); Chen Shen, Schenectady, NY (US); Scott Michael Oppenheimer, Niskayuna, NY (US); Patrick Thomas Brennan, Niskayuna, NY (US)

(73) Assignee: GE Infrastructure Technology LLC, Greenville, SC (US)

( * ) Notice: Subject to any disclaimer, the term of this patent is extended or adjusted under 35 U.S.C. 154(b) by 0 days.

(21) Appl. No.: 18/156,655

(22) Filed: Jan. 19, 2023

(65) Prior Publication Data

US 2024/0247345 A1 Jul. 25, 2024

(51) Int. Cl.
*C22C 27/02* (2006.01)
*C22C 32/00* (2006.01)

(52) U.S. Cl.
CPC ..... *C22C 27/02* (2013.01); *C22C 32/0078* (2013.01)

(58) Field of Classification Search
CPC ..... C22C 29/18; C22C 27/02; C22C 32/0078
See application file for complete search history.

(56) References Cited

U.S. PATENT DOCUMENTS

| | | | |
|---|---|---|---|
| 5,833,773 | A | 11/1998 | Bewlay et al. |
| 6,419,765 | B1 | 7/2002 | Jackson et al. |
| 6,428,910 | B1 | 8/2002 | Jackson et al. |
| 6,447,623 | B1 | 9/2002 | Jackson et al. |
| 6,521,356 | B2 | 2/2003 | Zhao et al. |
| 6,913,655 | B2 | 7/2005 | Jackson et al. |
| 2003/0066578 | A1 | 4/2003 | Jackson et al. |
| 2006/0147335 | A1* | 7/2006 | Bewlay ..... C22C 27/02 420/425 |
| 2007/0023109 | A1 | 2/2007 | Bewlay et al. |
| 2008/0142122 | A1 | 6/2008 | Bewlay et al. |
| 2011/0182766 | A1 | 7/2011 | Tsakiropoulos |

FOREIGN PATENT DOCUMENTS

| | | | |
|---|---|---|---|
| JP | 2018111853 | A | 7/2018 |
| WO | 2015079558 | A1 | 6/2015 |

OTHER PUBLICATIONS

Bewlay et al., "Recent Advances In Nb-Silicide In-Situ Composites," 15th International Plansee Seminar, Eds. G. Kneringer, P. Rödhammer and H. Wildner, Plansee Holding AG, Reutte (2001), vol. 1, pp. 404-419.

International Search Report and Written Opinion in PCT/US2023/080342, mailed Jun. 21, 2024, 11 pages.

* cited by examiner

*Primary Examiner* — Jessee R Roe
(74) *Attorney, Agent, or Firm* — James Pemrick; Charlotte Wilson; Hoffman Warnick LLC

(57) ABSTRACT

A niobium-silicide based alloy and a turbine having at least a turbine component formed from the niobium-silicide based alloy are provided. The niobium-silicide based alloy comprises: between about 14 atomic percent and about 24 atomic percent titanium (Ti); between about 11 atomic percent and about 19 atomic percent silicon (Si); between about 4 atomic percent and about 8 atomic percent chromium (Cr); between about 2 atomic percent and about 6 atomic percent hafnium (Hf); up to about 4 atomic percent aluminum (Al); between about 0.5 atomic percent and about 1 atomic percent tin (Sn); between about 5 atomic percent and about 15 atomic percent tantalum (Ta); between about 1 atomic percent and about 5 atomic percent tungsten (W); up to about 5 atomic percent rhenium (Re); up to about 5 atomic percent zirconium (Zr); up to about 6 atomic percent yttrium (Y); and a balance of niobium (Nb).

17 Claims, 4 Drawing Sheets

| | Compositions (atomic percent, at%) | | | | | | | | | | | | | |
|---|---|---|---|---|---|---|---|---|---|---|---|---|---|---|
| | Nb | Ti | Si | Cr | Hf | Al | Sn | W | Ta | Zr | Y | B | C | Re |
| Baseline (US6419765) | X | X | X | X | X | X | X | X | — | — | — | — | — | — |
| Alloy A | Balance | 20 | 18 | 5 | 5 | 2 | 0.75 | — | 5 | — | — | — | — | — |
| Alloy B | Balance | 20 | 18 | 5 | 5 | 2 | 0.75 | 2.5 | 5 | — | — | — | — | — |
| Alloy C | Balance | 20 | 18 | 5 | 5 | 2 | 0.75 | 5 | 5 | — | — | — | — | — |
| Alloy D | Balance | 20 | 18 | 7 | 3 | 2 | 0.75 | 3.5 | 10 | — | — | — | — | — |
| Alloy E | Balance | 20 | 18 | 5 | 5 | 2 | 0.75 | 5 | — | — | — | — | — | — |
| Alloy F | Balance | 20 | 18 | 5 | 5 | 2 | 0.75 | 10 | — | — | — | — | — | — |
| Alloy G | Balance | 20 | 18 | 5 | 5 | 2 | 0.75 | 2.5 | 5 | 3 | 0.5 | — | — | — |
| Alloy H | Balance | 20 | 18 | 5 | 5 | 2 | 0.75 | 2.5 | 5 | 5 | 0.5 | — | — | — |
| Alloy I | Balance | 20 | 18 | 7 | 3 | 2 | 0.75 | 3.5 | 10 | 2 | 0.5 | 2 | — | — |
| Alloy J | Balance | 20 | 18 | 7 | 3 | 2 | 0.75 | 2.5 | 7.5 | 1.5 | 0.5 | — | — | 1.5 |
| Alloy K | Balance | 20 | 18 | 5 | 5 | 2 | 0.75 | 2.5 | 5 | — | — | — | 3 | — |

FIG. 1

NIOBIUM-BASED ALLOY STRENGTHENED BY SILICIDE AND TURBINE HAVING TURBINE COMPONENT FORMED FROM

STATEMENT REGARDING FEDERALLY SPONSORED RESEARCH DEVELOPMENT

The United States Government may have certain rights in this invention pursuant to Contract No. DE-AR0001420, awarded by United States Department of Energy.

TECHNICAL FIELD

The disclosure relates generally to niobium (Nb)-based alloys strengthened by silicide (also referred to as "niobium (Nb)-silicide based alloys," or "Nb—Si based alloys" and used interchangeably throughout the current disclosure). More particularly, the disclosure relates to Nb—Si based alloys having high temperature strength and environmental resistance suitable for applications including turbine components, and a turbine having at least a turbine component formed from such Nb—Si based alloy.

BACKGROUND

Turbines (and their components) such as, but not limited to, aeronautical turbines, land-based turbines, marine-based turbines, and the like, have typically been formed from superalloys, often based on nickel (Ni). Turbine components formed from Ni-based superalloys generally exhibit desirable chemical and physical properties under the high temperature, high stress, and high-pressure conditions generally encountered during turbine operation. For example, turbine components, such as an airfoil, in modern jet engines can reach temperatures as high as about 1050° ° C., which can be as high as approximately 85% of the melting temperatures ($T_m$) of many Ni-based superalloys.

Because Ni-based superalloys have provided the level of performance desired in such applications, the development of such Ni-based superalloys has been widely explored. Consequently, the field has matured and few significant improvements have been realized in this area in recent years. In the meantime, efforts have been made to develop alternative turbine component materials. These alternate materials include Nb-based refractory metal intermetallic composites (hereinafter "RMICs"). Most RMICs have melting temperatures of about 1700° C. If RMICs can be used at about 80% of their melting temperatures, they would have potential use in applications in which the temperature exceeds the current service limit of Ni-based superalloys.

RMICs comprising at least niobium (Nb), silicon (Si), titanium (Ti), hafnium (Hf), chromium (Cr), and aluminum (Al) have been investigated for turbine component applications. Some known Nb-silicide based RMICs exhibit a high temperature capability that exceeds that of current Ni-based superalloys. Some known Nb-silicide based RMICs possess adequate oxidation resistance characteristics for turbine applications. Other known Nb-silicide based alloys have adequate fracture toughness for turbine component applications.

Although the above Nb-silicide based alloys possess beneficial mechanical and chemical properties, they do not adequately balance mechanical properties such as high-temperature strength and environmental resistance including oxidation resistance for applications in hot-section engine components such as airfoils, rotors, nozzles, shrouds, and exhaust components.

BRIEF DESCRIPTION

All aspects, examples and features mentioned below can be combined in any technically possible way.

An aspect of the disclosure provides a niobium-silicide based alloy that comprises: between about 14 atomic percent and about 24 atomic percent titanium (Ti); between about 11 atomic percent and about 19 atomic percent silicon (Si); between about 4 atomic percent and about 8 atomic percent chromium (Cr); between about 2 atomic percent and about 6 atomic percent hafnium (Hf); up to about 4 atomic percent aluminum (Al); between about 0.5 atomic percent and about 1 atomic percent tin (Sn); between about 5 atomic percent and about 15 atomic percent tantalum (Ta); between about 1 atomic percent and about 5 atomic percent tungsten (W); up to about 5 atomic percent rhenium (Re); up to about 5 atomic percent zirconium (Zr); up to about 6 atomic percent yttrium (Y); and a balance of niobium (Nb).

Another aspect of the disclosure includes any of the preceding aspects, and where a sum of the atomic percent of zirconium (Zr) and the atomic percent of yttrium (Y) present in the niobium-silicide based alloy is between about 0.2 atomic percent and about 11 atomic percent.

Another aspect of the disclosure includes any of the preceding aspects, and where the atomic percent of zirconium (Zr) is between about 0.1 atomic percent and about 5 atomic percent.

Another aspect of the disclosure includes any of the preceding aspects, and where the atomic percent of yttrium (Y) is between about 0.1 atomic percent and about 6 atomic percent.

Another aspect of the disclosure includes any of the preceding aspects, and where a sum of the atomic percent of tantalum (Ta) and the atomic percent of tungsten (W) present in the niobium-silicide based alloy is between about 5 atomic percent and about 20 atomic percent.

Another aspect of the disclosure includes any of the preceding aspects, and where the atomic percent of tantalum (Ta) is between about 5 atomic percent and about 10 atomic percent.

Another aspect of the disclosure includes any of the preceding aspects, and where the atomic percent of tungsten (W) is between about 2.5 atomic percent and about 5 atomic percent.

Another aspect of the disclosure includes any of the preceding aspects, and where the atomic percent of rhenium (Re) is between about 0.1 atomic percent and about 5 atomic percent.

Another aspect of the disclosure includes any of the preceding aspects, and where the niobium-silicide based alloy further comprises up to about 5 atomic percent boron (B), or up to about 5 atomic percent carbon (C), or both.

Another aspect of the disclosure includes any of the preceding aspects, and where the niobium-silicide based alloy includes at least one metallic phase, the metallic phase comprising at least 40 volume percent of the niobium-silicide based alloy.

Another aspect of the disclosure includes any of the preceding aspects, and where the metallic phase comprises between about 40 volume percent and about 60 volume percent of the niobium-silicide based alloy.

Another aspect of the disclosure includes any of the preceding aspects, and where the niobium-silicide based alloy further includes a tetragonal $Nb_5Si_3$ phase comprising at least 40 volume percent of the niobium-silicide based alloy.

Another aspect of the disclosure includes any of the preceding aspects, and where the niobium-silicide based alloy includes a tetragonal $Nb_5Si_3$ phase and a hexagonal $Nb_5Si_3$ phase, and a total volume percent of the tetragonal and hexagonal $Nb_5Si_3$ phases is between about 40 volume percent and about 60 volume percent of the niobium-silicide based alloy.

Another aspect of the disclosure includes any of the preceding aspects, and where the niobium-silicide based alloy is resistant to oxidation at temperatures at about 1300° C.

An aspect of the disclosure provides a turbine having at least a turbine component formed from a niobium-silicide based alloy, the niobium-silicide based alloy comprises: between about 14 atomic percent and about 24 atomic percent titanium (Ti); between about 11 atomic percent and about 19 atomic percent silicon (Si); between about 4 atomic percent and about 8 atomic percent chromium (Cr); between about 2 atomic percent and about 6 atomic percent hafnium (Hf); up to about 4 atomic percent aluminum (Al); between about 0.5 atomic percent and about 1 atomic percent tin (Sn); between about 5 atomic percent and about 15 atomic percent tantalum (Ta); between about 1 atomic percent and about 5 atomic percent tungsten (W); up to about 5 atomic percent rhenium (Re); up to about 5 atomic percent zirconium (Zr); up to about 6 atomic percent yttrium (Y); and a balance of niobium (Nb).

Another aspect of the disclosure includes any of the preceding aspects, and where a sum of the atomic percent of zirconium (Zr) and the atomic percent of yttrium (Y) present in the niobium-silicide based alloy is between about 0.2 atomic percent and about 11 atomic percent.

Another aspect of the disclosure includes any of the preceding aspects, and where the niobium-silicide based alloy further includes a tetragonal $Nb_5Si_3$ phase comprising at least 40 volume percent of the niobium-silicide based alloy.

Another aspect of the disclosure includes any of the preceding aspects, and where a sum of the atomic percent of tantalum (Ta) and the atomic percent of tungsten (W) present in the niobium-silicide based alloy is between about 5 atomic percent and about 20 atomic percent.

Another aspect of the disclosure includes any of the preceding aspects, and where the turbine component is one or more of a blade, a rotor, or a nozzle.

Another aspect of the disclosure includes any of the preceding aspects, and where the turbine is selected from the group consisting of land-based turbines, marine turbines, aeronautical turbines, and power generation turbines.

Two or more aspects described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which:

FIG. 1 is a table of non-limiting examples of various Nb—Si based alloys (alloys A-K) with each composition listed in atomic percent (at %) in each respective Nb—Si based alloy and a baseline alloy, according to embodiments of the disclosure;

Figure 2A:
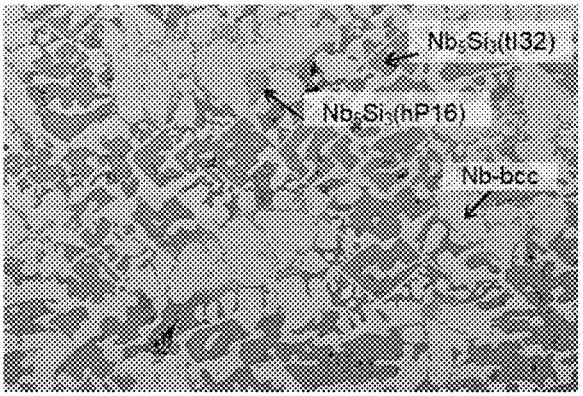
FIG. 2A is a scanning electron micrograph (SEM) of a microstructure of the Nb—Si based alloy A of the table in FIG. 1.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the subject matter of the current disclosure, it will become necessary to select certain terminology when referring to and describing relevant machine components within the current disclosure. To the extent possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

The terms "first", "second", and "third" may be used interchangeably to distinguish one component from another and are not intended to signify location or importance of the individual components.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof. "Optional" or "optionally" means that the subsequently described event or circumstance may or may not occur or that the subsequently describe component or element may or may not be present, and that the description includes instances where the event occurs or the component is present and instances where it does not or is not present.

Where an element or layer is referred to as being "on," "engaged to," "connected to" or "coupled to" another element or layer, it may be directly on, engaged to, connected to, or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

As indicated above, the disclosure provides Nb—Si based alloys having high-temperature strength and environmental resistance.

While the oxidation performance and creep-rupture resistance for turbine component applications of known RMICs are desirable, materials more suitable for turbines/turbine component applications are still needed. For example, materials that enhance both high temperature yield strength and oxidation resistance for applications that subject turbine components to high stresses at temperatures ranging from about 1300° C. to about 1700° C. over extended periods of time are needed.

The current disclosure provides a Nb-silicide based alloy that balances mechanical properties such as high-temperature strength and environmental resistance including oxidation resistance and is suitable for various applications including, but not limited to, turbine components, in which high stresses at elevated temperatures are encountered over long periods of time.

FIG. 1 is a table that includes non-limiting examples of various Nb—Si based alloys with compositions listed with elements in atomic percent (at %) in each respective Nb—Si based alloy, as embodied by the disclosure. If an element is absent from an alloy sample listed in FIG. 1, it is marked with a straight line in the respective cell in the table of FIG. 1. Each alloy is identified by a sample ID (e.g., alloy A, alloy B, alloy C, etc.). FIG. 1 further includes a baseline alloy that is used as a reference alloy in all the studies described in the instant disclosure. As shown in the table in FIG. 1, the baseline alloy is free of Ta, Zr, Y, B, C, and Re. The baseline alloy is a species of alloys described in U.S. Pat. No. 6,419,765, and the atomic percent of each element (Ti, Si, Cr, Hf, Al, Sn and W) present in the baseline alloy is within the respective range of atomic percent for each respective element (Ti, Si, Cr, Hf, Al, Sn and W) described in U.S. Pat. No. 6,419,765 and are generally represented here as "X" for simplicity. The baseline alloy may be labelled as "baseline (U.S. Pat. No. 6,419,765)" in the drawings.

It is to be highlighted that the table in FIG. 1 shows non-limiting embodiments for illustration purpose only and the examples illustrated in FIG. 1 are not intended to be limiting of the disclosure. For example, while specific atomic percent of elements is included in each alloy example for illustration purposes, atomic percent of each element is not limited to the specific value listed in the table in FIG. 1. Rather, atomic percent of each element of each alloy composition can be in its respective range as described throughout the current disclosure and embodied in the claims presented herein, including any value or sub-ranges not specifically listed but falls within the respective range of each element described in the disclosure.

In embodiments, a niobium-silicide based alloy of the instant disclosure comprises: between about 14 atomic percent and about 24 atomic percent titanium (Ti); between about 11 atomic percent and about 19 atomic percent silicon (Si); between about 4 atomic percent and about 8 atomic percent chromium (Cr); between about 2 atomic percent and about 6 atomic percent hafnium (Hf); up to about 4 atomic percent aluminum (Al); between about 0.5 atomic percent and about 1 atomic percent tin (Sn); between about 5 atomic percent and about 15 atomic percent tantalum (Ta); between about 1 atomic percent and about 5 atomic percent tungsten (W); up to about 5 atomic percent rhenium (Re); up to about 5 atomic percent zirconium (Zr); up to about 6 atomic percent yttrium (Y); and a balance of niobium (Nb).

In embodiments, the atomic percent of titanium (Ti) in the niobium-silicide based alloy of the instant disclosure can be a value between about 14 and about 24, such as about 14, about 15, about 16, about 17, about 18, about 19, about 20, about 21, about 22, about 23, about 24, or a range between any two of the above values. For example, in non-limiting embodiments, the atomic percent of titanium (Ti) in the niobium-silicide based alloy may be present in a range between about 14 and about 24 atomic percent, or about 14 and about 20 atomic percent, or about 20 and about 24 atomic percent, or about 18 and about 22 atomic percent, or about 19 and about 21 atomic percent.

In embodiments, the atomic percent of silicon (Si) in the niobium-silicide based alloy of the instant disclosure can be a value between about 11 and about 19, such as about 11, about 12, about 13, about 14, about 15, about 16, about 17, about 18, about 19, or a range between any two of the above values. For example, in non-limiting embodiments, the atomic percent of silicon (Si) in the niobium-silicide based alloy may be present in a range between about 11 and about 19 atomic percent, or about 11 and about 15 atomic percent, or about 15 and about 19 atomic percent, or about 17 and about 19 atomic percent.

In embodiments, the atomic percent of chromium (Cr) in the niobium-silicide based alloy of the instant disclosure can be a value between about 4 and about 8, such as about 4, about 5, about 6, about 7, about 8, or a range between any two of the above values. For example, in non-limiting embodiments, the atomic percent of chromium (Cr) in the niobium-silicide based alloy may be present in a range between about 4 and about 8 atomic percent, or about 4 and about 6 atomic percent, or about 6 and about 8 atomic percent, or about 5 and about 7 atomic percent.

In embodiments, the atomic percent of hafnium (Hf) in the niobium-silicide based alloy of the instant disclosure can be a value between about 2 and about 6, such as about 2, about 3, about 4, about 5, about 6, or a range between any two of the above values. For example, in non-limiting embodiments, the atomic percent of hafnium (Hf) in the niobium-silicide based alloy may be present in a range between about 2 and about 6 atomic percent, or about 2 and about 4 atomic percent, or about 4 and about 6 atomic percent, or about 3 and about 5 atomic percent.

In embodiments, the atomic percent of aluminum (Al) in the niobium-silicide based alloy of the instant disclosure can be a value between about 0 and about 4, such as about 0.1, about 0.2, about 0.5, about 1, about 2, about 3, about 4, or a range between any two of the above values. For example, in non-limiting embodiments, the atomic percent of aluminum (Al) in the niobium-silicide based alloy may be present in a range between about 0 and about 4 atomic percent, or about 0.1 and about 4 atomic percent, or about 0.5 and about 4 atomic percent, or about 1 and about 3 atomic percent, or about 1.5 and about 2.5 atomic percent.

In embodiments, the atomic percent of tin (Sn) in the niobium-silicide based alloy of the instant disclosure can be a value between about 0.5 and about 1, such as about 0.5, about 0.6, about 0.7, about 0.8, about 0.9, about 1, or a range between any two of the above values. For example, in non-limiting embodiments, the atomic percent of tin (Sn) in the niobium-silicide based alloy may be present in a range between about 0.5 and about 1 atomic percent, or about 0.5 and about 0.75 atomic percent, or about 0.75 and about 1 atomic percent, or about 0.7 and about 0.8 atomic percent.

In embodiments, the atomic percent of tantalum (Ta) in the niobium-silicide based alloy of the instant disclosure can be a value between about 5 and about 15, such as about 5, about 6, about 7, about 8, about 9, about 10, about 11, about 12, about 13, about 14, about 15, or a range between any two of the above values. For example, in non-limiting embodiments, the atomic percent of tantalum (Ta) in the niobium-silicide based alloy may be present in a range between about 5 and about 15 atomic percent, or about 5 and about 10 atomic percent, or about 10 and about 15 atomic percent, or about 6.5 and about 8.5 atomic percent, or about 7 and about 8 atomic percent, or about 5 and about 8 atomic percent.

In embodiments, the atomic percent of tungsten (W) in the niobium-silicide based alloy of the instant disclosure can be a value between about 1 and about 5, such as about 1, about 2, about 3, about 4, about 5, or a range between any two of the above values. For example, in non-limiting embodiments, the atomic percent of tungsten (W) in the niobium-silicide based alloy may be present in a range between about 1 and about 5 atomic percent, or about 1 and about 3 atomic percent, or about 2 and about 5 atomic percent, or about 2 and about 3 atomic percent, or about 2.5 and about 5 atomic percent, or about 3 and about 4 atomic percent.

In embodiments, the atomic percent of rhenium (Re) in the niobium-silicide based alloy of the instant disclosure can be a value between about 0 and about 5, such as about 0.1, about 0.2, about 0.5, about 1, about 2, about 3, about 4, about 5, or a range between any two of the above values. For example, in non-limiting embodiments, the atomic percent of rhenium (Re) in the niobium-silicide based alloy may be present in a range between about 0 and about 5 atomic percent, or about 0.1 and about 5 atomic percent, or about 0.1 and about 2 atomic percent, or about 0.5 and about 2.5 atomic percent.

In embodiments, the atomic percent of zirconium (Zr) in the niobium-silicide based alloy of the instant disclosure can be a value between about 0 and about 5, such as about 0.1, about 0.2, about 0.5, about 1, about 2, about 3, about 4, about 5, or a range between any two of the above values. For example, in non-limiting embodiments, the atomic percent of zirconium (Zr) in the niobium-silicide based alloy may be present in a range between about 0.1 and about 5 atomic percent, or about 0.1 and about 3 atomic percent, or about 0.1 and about 2 atomic percent, or about 0.1 and about 1.5 atomic percent, or about 1.5 and about 5 atomic percent, or about 1 and about 3 atomic percent, or about 3 and about 5 atomic percent.

In embodiments, the atomic percent of yttrium (Y) in the niobium-silicide based alloy of the instant disclosure can be a value between about 0 and about 6, such as about 0.1, about 0.2, about 0.5, about 1, about 2, about 3, about 4, about 5, about 6, or a range between any two of the above values. For example, in non-limiting embodiments, the atomic percent of yttrium (Y) in the niobium-silicide based alloy may be present in a range between about 0.1 and about 6 atomic percent, or about 0.1 and about 5 atomic percent, or about 0.1 and about 4 atomic percent, or about 0.1 and about 3 atomic percent, or about 0.1 and about 2 atomic percent, or about 0.1 and about 1 atomic percent, or about 0.2 and about 0.8 atomic percent.

In embodiments, a sum of the atomic percent of zirconium (Zr) and the atomic percent of yttrium (Y) present in the niobium-silicide based alloy can be a value between about 0.1 and about 11, such as about 0.1, about 0.2, about 0.5, about 1, about 1.5, about 2, about 2.5, about 3, about 3.5, about 4, about 4.5, about 5, about 5.5, about 6, about 7, about 8, about 9, about 10, about 11, or a range between any two of the above values. For example, in non-limiting embodiments, a sum of the atomic percent of zirconium (Zr) and the atomic percent of yttrium (Y) present in the niobium-silicide based alloy is in a range between about 0.1 atomic percent and about 11 atomic percent, about 0.2 atomic percent and about 11 atomic percent, or about 0.5 atomic percent and about 11 atomic percent, or about 0.5 atomic percent and about 6 atomic percent, or about 0.5 atomic percent and about 4 atomic percent, or about 0.5 atomic percent and about 2 atomic percent, or about 2 atomic percent and about 11 atomic percent, or about 2 atomic percent and about 6 atomic percent, or about 2.5 atomic percent and about 5.5 atomic percent, or about 3 atomic percent and about 11 atomic percent, or about 3 atomic percent and about 6 atomic percent.

In embodiments, a sum of the atomic percent of zirconium (Zr) and the atomic percent of yttrium (Y) present in the niobium-silicide based alloy is between about 0.2 atomic percent and about 11 atomic percent.

In embodiments, a sum of the atomic percent of tantalum (Ta) and the atomic percent of tungsten (W) present in the niobium-silicide based alloy can be a value between about 5 and about 20, such as about 5, about 6, about 7, about 8, about 9, about 10, about 11, about 12, about 13, about 14, about 15, about 16, about 17, about 18, about 19, about 20, or a range between any two of the above values. For example, in non-limiting embodiments, a sum of the atomic percent of tantalum (Ta) and the atomic percent of tungsten (W) present in the niobium-silicide based alloy is in a range between about 5 atomic percent and about 20 atomic percent, about 5 atomic percent and about 15 atomic percent, or about 7 atomic percent and about 15 atomic percent, or about 10 atomic percent and about 18 atomic percent, or about 10 atomic percent and about 15 atomic percent, or about 12 atomic percent and about 16 atomic percent, or about 13 atomic percent and about 15 atomic percent.

In some embodiments, the niobium-silicide based alloy includes up to about 5 atomic percent boron (B), or up to about 5 atomic percent carbon (C), or both.

In embodiments, the niobium-silicide based alloy of the instant disclosure may include up to about 5 atomic percent boron (B). The atomic percent of boron (B) can be a value between about 0 and about 5, such as about 0.1, about 0.2, about 0.5, about 1, about 2, about 3, about 4, about 5, or a range between any two of the above values. For example, in non-limiting embodiments, the atomic percent of boron (B) in the niobium-silicide based alloy may be present in a range between about 0 and about 5 atomic percent, or about 0.1 and about 5 atomic percent, or about 0.1 and about 4 atomic percent, or about 0.1 and about 3 atomic percent, or about 2 and about 4 atomic percent. In embodiments, the niobium-silicide based alloy of the instant disclosure may include up to about 5 atomic percent carbon (C). The atomic percent of carbon (C) can be a value between about 0 and about 5, such as about 0.1, about 0.2, about 0.5, about 1, about 2, about 3, about 4, about 5, or a range between any two of the above values. For example, in non-limiting embodiments, the atomic percent of carbon (C) in the niobium-silicide based alloy may be present in a range between about 0 and about 5 atomic percent, or about 0.1 and about 5 atomic percent, or about 0.1 and about 4 atomic percent, or about 0.1 and about 3 atomic percent, or about 2 and about 4 atomic percent.

The niobium-silicide based alloys of the instant disclosure may further include molybdenum (Mo) for tuning properties of the alloys for specific applications. In embodiments, the niobium-silicide based alloy may further include up to about 5 atomic percent molybdenum (Mo). The atomic percent of molybdenum (Mo) can be a value between about 0 and about 5, such as about 0.1, about 0.2, about 0.5, about 1, about 2, about 3, about 4, about 5, or a range between any two of the above values. For example, in non-limiting embodiments, the atomic percent of molybdenum (Mo) in the niobium-silicide based alloy may be present in a range between about 0 and about 5 atomic percent, or about 0.1 and about 5 atomic percent, or about 0.1 and about 4 atomic percent, or about 0.1 and about 3 atomic percent, or about 0.1 and about 2 atomic percent, or about 0.1 and about 1.5 atomic percent.

Figure 2B:
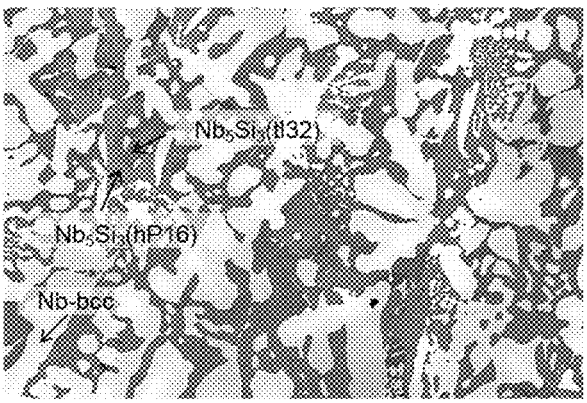
FIG. 2B is a scanning electron micrograph of a microstructure of the Nb—Si based alloy C of the table in FIG. 1.
Figure 2C:
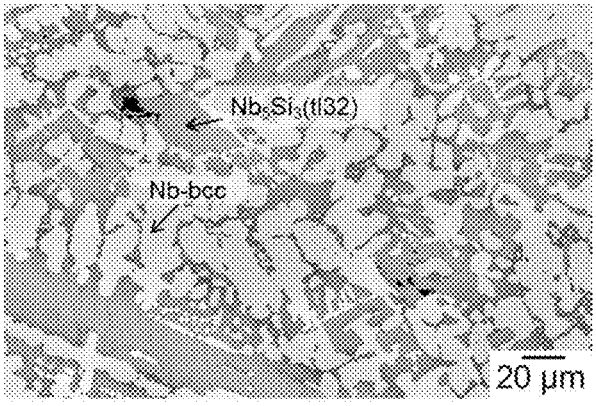
FIG. 2C is a scanning electron micrograph of a microstructure of the Nb—Si based alloy D of the table in FIG. 1, according to embodiments of the disclosure.

FIG. 2A is a scanning electron micrograph (SEM) of a microstructure of the Nb—Si based alloy A of the table in FIG. 1; FIG. 2B is a scanning electron micrograph of a microstructure of the Nb—Si based alloy C of the table in FIG. 1; and FIG. 2C is a scanning electron micrograph of a microstructure of the Nb—Si based alloy D of the table in FIG. 1, according to embodiments of the disclosure. Materials used in the SEM image were prepared by arc melting a respective alloy followed by a heat treatment at 1400° C. for 6 hours.

Nb—Si based alloy of the instant disclosure includes at least one metallic phase (e.g., "Nb-bcc" illustrated in FIGS. 2A-2C). In embodiments, the metallic phase includes at least 40 volume percent of the Nb—Si based alloy. In some embodiments, the metallic phase includes between about 40 volume percent and about 60 volume percent of the Nb—Si based alloy.

Nb-silicide in the Nb—Si based alloy may exist in 2 phases: a tetragonal $Nb_5Si_3$ phase (e.g., "$Nb_5Si_3$ (tI 32)"), and/or a hexagonal $Nb_5Si_3$ phase ("$Nb_5Si_3$ (hP16)"), as illustrated in FIGS. 2A-2C. Tetragonal $Nb_5Si_3$ phase is desired for certain mechanical properties of the Nb—Si based alloy such as increased creep strength, whereas the hexagonal $Nb_5Si_3$ phase is generally undesired due to weakened creep strength.

In certain embodiments, the Nb—Si based alloy includes a tetragonal $Nb_5Si_3$ phase having at least 40 volume percent of Nb—Si based alloy. In some embodiments, the Nb—Si based alloy includes a tetragonal $Nb_5Si_3$ phase and a hexagonal $Nb_5Si_3$ phase, and a total volume percent of the tetragonal and hexagonal $Nb_5Si_3$ phases is between about 40 volume percent and about 60 volume percent of the Nb—Si based alloy.

Compositions of alloys A, C, and D used in FIGS. 2A, 2B, and 2C, respectively, are the same as alloys A, C, and D in the table in FIG. 1 and are listed below:

As shown above, the main differences between alloys A, C, and D is the atomic percent of W and Ta in the Nb—Si based alloys. While alloy A includes 5 at % Ta, alloy C includes an additional 5 at % W compared to alloy A, and alloy D includes a high Ta addition of 10 at % Ta and 3.5 at % W.

As illustrated in FIG. 2A, for alloy A, majority of Nb-silicide exists in the tetragonal phase, while only a small fraction of Nb-silicide exists in the hexagonal phase. Microstructure illustrated in FIG. 2B for alloy C shows that addition of 5 at % W to alloy A increases the fraction of hexagonal phase significantly, with the tetragonal phase and the hexagonal phase in a ratio of about 1:1 based on the volume percent of each respective phase. However, a higher Ta addition (10 at % Ta) allows Nb-silicide to exist almost exclusively in the tetragonal phase in alloy D, as illustrated in FIG. 2C, while accommodating certain atomic percent of W (e.g., 3.5 at % in alloy D) in the alloy. Having the ability to add modest amount of W is beneficial because as described in detail below with respect to FIG. 3, addition of W could contribute to high yield strength (MPa) in compression at 1300° C.

In summary, comparisons of the SEM results of alloys A, C, and D shows that: (1) majority of Nb-silicide exists in the tetragonal phase in alloys with no W; (2) addition of 5 at % W increases the fraction of the undesired hexagonal phase; and (3) a high Ta addition has the surprising advantages and allows the fraction of the desired tetragonal phase to be significantly stabilized and the undesired hexagonal phase eliminated while allowing modest amount of W to be present in the alloys. This further demonstrates that the delicate balance between elements of the alloys (e.g., Ta, W) plays an important role in the alloy microstructures, which, in turn, could affect alloy mechanical properties and environmental resistance.

Figure 3:
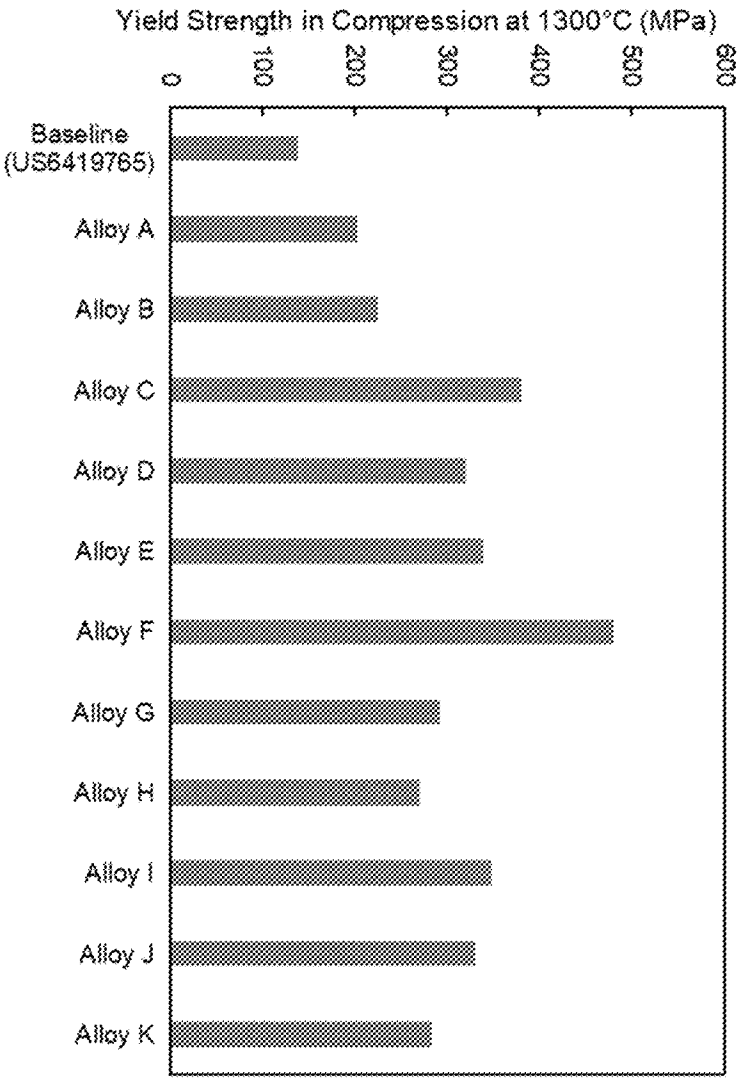
FIG. 3 is a graph showing yield strength (MegaPascal, MPa) in compression at 1300° C. for the alloys listed in the table in FIG. 1, according to embodiments of the disclosure.

FIG. 3 is a graph showing yield strength (MPa) in compression at 1300° C. for the baseline alloy and alloys A-K listed in the table in FIG. 1, according to embodiments of the disclosure.

As shown in FIG. 3, all alloys A-K exhibit significantly higher yield strength (MPa) in compression at 1300° ° C. compared to the baseline alloy. Importantly, the presence of Ta and W significantly contribute to the high yield strength of the Nb—Si based alloys. For example, comparing the baseline alloy and alloys A-F, it was calculated that contribution of Ta to the high yield strength (MPa) in compression at 1300° C. is about 7-10 MPa/at %, and contribution of W to the high yield strength (MPa) in compression at 1300° C. is about 40-60 MPa/at %. The addition of Ta and W is beneficial to the high yield strength of the Nb—Si based alloys.

Furthermore, comparing alloy B with alloys G and H (compositions listed in the table in FIG. 1 and copied below), it can be seen that the main differences between alloys B, G, and H are the atomic percent of Zr and Y in each respective Nb—Si based alloy.

| | Compositions (atomic percent, at %) | | | | | | | | | | | | |
|---|---|---|---|---|---|---|---|---|---|---|---|---|---|
| Alloy ID | Nb | Ti | Si | Cr | Hf | Al | Sn | W | Ta | Zr | Y | B | C | Re |
| Alloy A | Balance | 20 | 18 | 5 | 5 | 2 | 0.75 | | 5 | | | | | |
| Alloy C | Balance | 20 | 18 | 5 | 5 | 2 | 0.75 | 5 | 5 | | | | | |
| Alloy D | Balance | 20 | 18 | 7 | 3 | 2 | 0.75 | 3.5 | 10 | | | | | |

| | Compositions (atomic percent, at %) | | | | | | | | | | | | |
|---|---|---|---|---|---|---|---|---|---|---|---|---|---|
| Alloy ID | Nb | Ti | Si | Cr | Hf | Al | Sn | W | Ta | Zr | Y | B | C | Re |
| Alloy B | Balance | 20 | 18 | 5 | 5 | 2 | 0.75 | 2.55 | 5 | | | | | |
| Alloy G | Balance | 20 | 18 | 5 | 5 | 2 | 0.75 | 2.5 | 5 | 3 | 0.5 | | | |
| Alloy H | Balance | 20 | 18 | 5 | 5 | 2 | 0.75 | 2.55 | 5 | 5 | 0.5 | | | |

As illustrated in FIG. 3, alloys G and H both have improved yield strength (MPa) in compression at 1300° C. than alloy B. The combined addition of Zr and Y contribute to the improved yield strength in the Nb—Si based alloys.

It is to be noted that the alloy samples used in FIG. 3 are no-limiting embodiments. In certain embodiments, a sum of the atomic percent of zirconium (Zr) and the atomic percent of yttrium (Y) present in the niobium-silicide based alloy can be a value between about 0.1 and about 11, such as about 0.1, about 0.2, about 0.5, about 1, about 2, about 3, about 4, about 5, about 6, about 7, about 8, about 9, about 10, about 11, or a range between any two of the above values. For example, in non-limiting embodiments, a sum of the atomic percent of zirconium (Zr) and the atomic percent of yttrium (Y) present in the niobium-silicide based alloy is in a range between about 0.1 atomic percent and about 11 atomic percent, about 0.2 atomic percent and about 11 atomic percent, or about 0.5 atomic percent and about 11 atomic percent, or about 0.5 atomic percent and about 6 atomic percent, or about 0.5 atomic percent and about 4 atomic percent, or about 0.5 atomic percent and about 2 atomic percent, or about 2 atomic percent and about 11 atomic percent, or about 2 atomic percent and about 6 atomic percent, or about 3 atomic percent and about 11 atomic percent, or about 3 atomic percent and about 6 atomic percent.

In embodiments, a sum of the atomic percent of zirconium (Zr) and the atomic percent of yttrium (Y) present in the niobium-silicide based alloy is between about 0.2 atomic percent and about 11 atomic percent.

Figure 4:
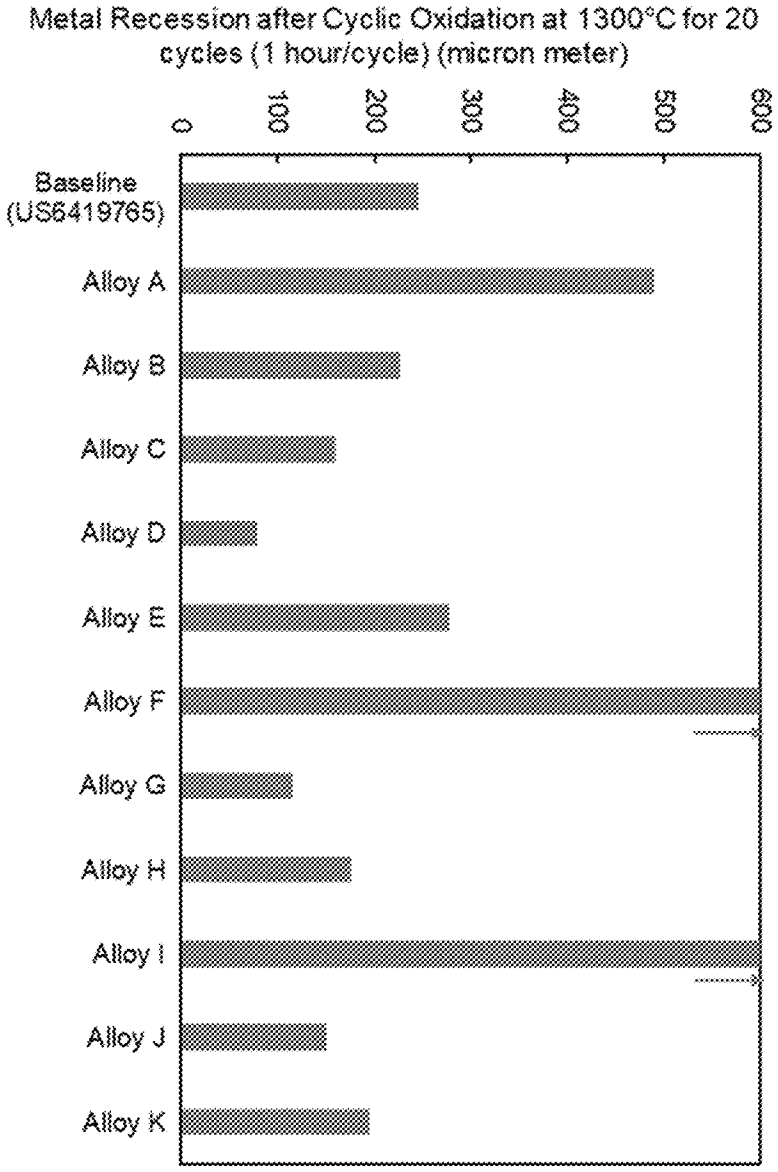
FIG. 4 is a graph showing metal recession (micron meter, μm) after cyclic oxidation at 1300° C. for 20 cycles (1 hour per cycle) for the alloys listed in the table in FIG. 1, according to embodiments of the disclosure.

FIG. 4 is a graph showing metal recession (micron meter, μm) after cyclic oxidation at 1300° C. for 20 cycles (to 1 hour per cycle) for baseline alloy and alloys A-K listed in the table in FIG. 1, according to embodiments of the disclosure. Each respective alloy was heated at 1300° ° C. for 1 hour during each of the 20 cycles. Metal recession was calculated by measuring an initial thickness (μm) of a coupon ($t_0$), and after exposure, measuring a thickness (μm) of remaining metal thickness ($t_1$). Metal recession (μm) is then defined/calculated by $(t_0-t_1)/2$.

Results of FIG. 4 (based on the alloys A-J listed in the table in FIG. 1) and other previous results show that:

(1) Addition of Ta or W affects metal recession.

The main differences between alloys A, E, and F are its respective atomic percent of Ta and/or W. Alloy A includes 5 at % Ta, alloy E includes 5 at % W, and alloy F includes 10 at % W. Alloys A, E, and F are listed in the table in FIG. 1 and copied below.

| | Compositions (atomic percent, at %) | | | | | | | | | | | | |
|---|---|---|---|---|---|---|---|---|---|---|---|---|---|
| Alloy ID | Nb | Ti | Si | Cr | Hf | Al | Sn | W | Ta | Zr | Y | B | C | Re |
| Alloy A | Balance | 20 | 18 | 5 | 5 | 2 | 0.75 | | 5 | | | | | |
| Alloy E | Balance | 20 | 18 | 5 | 5 | 2 | 0.75 | 5 | | | | | | |
| Alloy F | Balance | 20 | 18 | 5 | 5 | 2 | 0.75 | 10 | | | | | | |

Compared to Ta, W appears to have less detrimental effects on increasing metal recession. For example, alloy E, which includes 5 at % W, has less detrimental effects on increasing metal recession than alloy A, which includes 5 at % Ta. As illustrated in FIG. 3, Modest amount of W (e.g., 5 at %) might be accommodated in the alloys while not significantly affecting the oxidation profile of the alloy. However, as seen in comparisons between alloy F (10 at % W) and alloy E (5 at % W), high addition of W leads to much higher metal recession. This further demonstrates the delicate balancing effects between selecting desirable elements and values/ranges in the Nb—Si based alloys. While W has been shown to contribute significantly to desired high yield strength (as discussed with respect to FIG. 3), high addition of W may negatively affect microstructures (as discussed with respect to FIGS. 2A-2C) and also may have much higher metal recession. In addition, while Ta (e.g., 5 at % and 10 at % Ta as discussed with respect to FIGS. 2A-2C) has been shown to help stabilize desired tetragonal $Nb_5Si_3$ phase, 5 at % Ta is shown to negatively impact the oxidation by increasing metal recession in the alloy.

(2) Alloys with both Ta and W (alloys B, C, D) show significantly reduced metal recession than alloys that only contain either Ta (alloy A) or W (alloys E and F).

Surprisingly, it was discovered by inventors of the instant disclosure that a synergistic effect of combined addition of Ta and W exist in the Nb—Si alloys embodied in the disclosure. Alloys A-F are listed in the table in FIG. 1 and copied below:

| | Compositions (atomic percent, at %) | | | | | | | | | | | | |
|---|---|---|---|---|---|---|---|---|---|---|---|---|---|
| Alloy ID | Nb | Ti | Si | Cr | Hf | Al | Sn | W | Ta | Zr | Y | B | C | Re |
| Alloy A | Balance | 20 | 18 | 5 | 5 | 2 | 0.75 | | 5 | | | | | |
| Alloy B | Balance | 20 | 18 | 5 | 5 | 2 | 0.75 | 2.5 | 5 | | | | | |
| Alloy C | Balance | 20 | 18 | 5 | 5 | 2 | 0.75 | 5 | 5 | | | | | |
| Alloy D | Balance | 20 | 18 | 7 | 3 | 2 | 0.75 | 3.5 | 10 | | | | | |
| Alloy E | Balance | 20 | 18 | 5 | 5 | 2 | 0.75 | 5 | | | | | | |
| Alloy F | Balance | 20 | 18 | 5 | 5 | 2 | 0.75 | 10 | | | | | | |

As shown above, alloys B and C include additional 2.5 at % and 5 at % of W, respectively, compared to alloy A. As illustrated in FIG. 4, both alloys B and C have significantly reduced metal recession compared to alloy A. Alloy D, which has even higher combined atomic percent of Ta and W, exhibit the most reduced metal recession compared to alloys A, B, and C. Furthermore, surprisingly, as the sum of the atomic percent of Ta and the atomic percent of W present in the Nb—Si based alloy increases, (e.g., from A (Ta+W at %=5), B (Ta+W at %=7.5) to C (Ta+W at %=10) to D (Ta+W at %=13.5), the metal recession of the respective alloy reduces.

Observations (1) and (2) above show that both individual atomic percentages of Ta and W and combined atomic percent of Ta and W play important roles in developing Nb—Si based alloys with desirable microstructures, high mechanical strength, and robust oxidation resistance. The advantageous, synergistic effects of the combined addition of Ta and W in the Nb—Si alloys are unexpected.

It is to be noted that the alloy samples used in FIG. 4 and the sum of the atomic percent of Ta and the atomic percent of W present in each alloy sample are non-limiting embodiments. The sum of the atomic percent of Ta and the atomic percent of W present in the niobium-silicide based alloy can be a value or a range as described in earlier sections of the instant disclosure and is omitted here for brevity.

(3) Combined addition of Zr and Y reduces metal recession.

For example, alloys B, G, and H are listed in the table in FIG. 1 and copied below:

| | Compositions (atomic percent, at %) | | | | | | | | | | | | |
|---|---|---|---|---|---|---|---|---|---|---|---|---|---|
| Alloy ID | Nb | Ti | Si | Cr | Hf | Al | Sn | W | Ta | Zr | Y | B | C | Re |
| Alloy B | Balance | 20 | 18 | 5 | 5 | 2 | 0.75 | 2.55 | 5 | | | | | |
| Alloy G | Balance | 20 | 18 | 5 | 5 | 2 | 0.75 | 2.55 | 5 | 3 | 0.5 | | | |
| Alloy H | Balance | 20 | 18 | 5 | 5 | 2 | 0.75 | 2.55 | 5 | 5 | 0.5 | | | |

The main differences between alloys B, G, and H are the atomic percent of Zr and Y in the Nb—Si based alloys. As illustrated in FIG. 4, alloys G and H both have significantly reduced metal recession at 1300° C. than alloy B. Combined addition of Zr and Y contribute to the significantly improved oxidation resistance in the Nb—Si based alloys.

It is to be noted that the alloy samples used in FIG. 4 are non-limiting embodiments. In certain embodiments, a sum of the atomic percent of zirconium (Zr) and the atomic percent of yttrium (Y) present in the niobium-silicide based alloy can be a value or a range as described in earlier sections of the instant disclosure and is omitted here for brevity.

Referring to both FIGS. 3 and 4, it could be further seen that:

(4) Addition of carbon (C) in the Nb—Si based alloys improves yield strength and reduces metal recession of the Nb—Si based alloys.

For example, alloys B, G, H, and K are listed in the table in FIG. 1 with compositions copied below:

| | Compositions (atomic percent, at %) | | | | | | | | | | | | |
|---|---|---|---|---|---|---|---|---|---|---|---|---|---|
| Alloy ID | Nb | Ti | Si | Cr | Hf | Al | Sn | W | Ta | Zr | Y | B | C | Re |
| Alloy B | Balance | 20 | 18 | 5 | 5 | 2 | 0.75 | 2.5 | 5 | | | | | |
| Alloy G | Balance | 20 | 18 | 5 | 5 | 2 | 0.75 | 2.5 | 5 | 3 | 0.5 | | | |
| Alloy H | Balance | 20 | 18 | 5 | 5 | 2 | 0.75 | 2.5 | 5 | 5 | 0.5 | | | |
| Alloy K | Balance | 20 | 18 | 5 | 5 | 2 | 0.75 | 2.5 | 5 | | | | 2 | |

As illustrated in FIG. 3, alloys G, H, and K all has increased yield strength and reduced metal recession at 1300° C. than alloy B. In addition, alloy K has a yield strength and metal recession comparable to those of alloy G and H at 1300° C. Addition of carbon (C) contribute to the improved mechanical strength and oxidation resistance in the Nb—Si based alloys.

In certain embodiments, the atomic percent of carbon (C) present in the niobium-silicide based alloy can be a value or a range as described in earlier sections of the instant disclosure and is omitted here for brevity.

(5) Addition of rhenium (Re) in the Nb—Si based alloys is tolerated and does not negatively affect metal recession of the Nb—Si based alloys.

For example, alloy J (listed in the table in FIG. 1), which includes about 1.5 at % Re, has both high yield strength (>300 MPa) and low metal recession (similar to alloys G and H) at 1300° C.

The Nb—Si based alloys of the current disclosure can be used in high temperature applications that require high temperature (e.g., at about 1300° C. or higher) and is resistant to oxidation at such high temperature. In embodiments, the Nb—Si based alloy of the current disclosure is resistant to oxidation at temperatures at about 1300° C. The Nb—Si based alloys of the instant disclosure could find potential uses in applications where temperatures ranging from about 1300° ° C. to about 1700° ° C. are applied. The Nb—Si based alloys of the instant disclosure successfully achieve balanced mechanical properties and environmental resistance via controlling balancing effects of various compositions in the alloys. For example, by utilizing various interaction effects of respective atomic percent of Ta, W, Zr, Y, B, C, Re, a sum of a combined addition of Ta and W, a sum of combined Zr and Y, alloys with desirable mechanical properties and environmental resistance are developed for applications including, but not limited to, turbines or turbine components, in which high stresses at elevated temperatures are encountered over long periods of time.

Nb—Si based alloys of the instant disclosure can be used in turbines or turbine components. In embodiment, a turbine having at least a turbine component formed from a niobium-silicide based alloy, the niobium-silicide based alloy comprises: between about 14 atomic percent and about 24 atomic percent titanium (Ti); between about 11 atomic percent and about 19 atomic percent silicon (Si); between about 4 atomic percent and about 8 atomic percent chromium (Cr); between about 2 atomic percent and about 6 atomic percent hafnium (Hf); up to about 4 atomic percent aluminum (Al); between about 0.5 atomic percent and about 1 atomic percent tin (Sn); between about 5 atomic percent and about 15 atomic percent tantalum (Ta); between about 1 atomic percent and about 5 atomic percent tungsten (W); up to about 5 atomic percent rhenium (Re); up to about 5 atomic percent zirconium (Zr); up to about 6 atomic percent yttrium (Y); and a balance of niobium (Nb).

In embodiments, a sum of the atomic percent of zirconium (Zr) and the atomic percent of yttrium (Y) present in the Nb—Si based alloy in the turbine component is between about 0.2 atomic percent and about 11 atomic percent.

In embodiments, the Nb—Si based alloy in the turbine component further includes a tetragonal $Nb_5Si_3$ phase comprising at least 40 volume percent of the niobium-silicide based alloy.

In embodiments, the turbine component is one or more of a blade, a rotor, or a nozzle.

In embodiments, the turbine is selected from the group consisting of land-based turbines, marine turbines, aeronautical turbines, and power generation turbines.

The foregoing drawings show some of the processing associated according to several embodiments of this disclosure. In this regard, each drawing or block within a flow diagram of the drawings represents a process associated with embodiments of the method described. It should also be noted that in some alternative implementations, the acts noted in the drawings or blocks may occur out of the order noted in the figure or, for example, may in fact be executed substantially concurrently or in the reverse order, depending upon the act involved. Also, one of ordinary skill in the art will recognize that additional blocks that describe the processing may be added.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately," as applied to a particular value of a range, applies to both end values and, unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application and to enable others of ordinary skill in the art to understand the disclosure for various embodiments with various modifications as are suited to the particular use contemplated.

What is claimed is:

1. A niobium-silicide based alloy comprising:

between about 14 atomic percent and about 24 atomic percent titanium (Ti);

between about 11 atomic percent and about 14 atomic percent silicon (Si);

between about 4 atomic percent and about 8 atomic percent chromium (Cr);

between about 2 atomic percent and about 6 atomic percent hafnium (Hf);

between about 0.1 atomic percent and up to about 4 atomic percent aluminum (Al);

between about 0.5 atomic percent and about 1 atomic percent tin (Sn);

between about 5 atomic percent and about 15 atomic percent tantalum (Ta);

between about 1 atomic percent and about 5 atomic percent tungsten (W);

between about 0.1 atomic percent and about 5 atomic percent rhenium (Re);

between about 0.1 atomic percent and about 5 atomic percent zirconium (Zr);

between about 0.1 atomic percent and about 6 atomic percent yttrium (Y); and a balance of niobium (Nb).

2. The niobium-silicide based alloy of claim 1, wherein a sum of the atomic percent of zirconium (Zr) and the atomic percent of yttrium (Y) present in the niobium-silicide based alloy is between about 0.2 atomic percent and about 11 atomic percent.

3. The niobium-silicide based alloy of claim 1, wherein the atomic percent of tantalum (Ta) is between about 5 atomic percent and about 10 atomic percent.

4. The niobium-silicide based alloy of claim 1, wherein the atomic percent of tungsten (W) is between about 2.5 atomic percent and about 5 atomic percent.

5. The niobium-silicide based alloy of claim 1, further comprising up to about 5 atomic percent boron (B), or up to about 5 atomic percent carbon (C), or both.

6. The niobium-silicide based alloy of claim 1, wherein the niobium-silicide based alloy includes at least one metallic phase, the metallic phase comprising at least 40 volume percent of the niobium-silicide based alloy.

7. The niobium-silicide based alloy of claim 6, wherein the metallic phase comprises between about 40 volume percent and about 60 volume percent of the niobium-silicide based alloy.

8. The niobium-silicide based alloy of claim 6, wherein the niobium-silicide based alloy further includes a tetragonal $Nb_5Si_3$ phase comprising at least 40 volume percent of the niobium-silicide based alloy.

9. The niobium-silicide based alloy of claim 1, wherein the niobium-silicide based alloy includes a tetragonal $Nb_5Si_3$ phase and a hexagonal $Nb_5Si_3$ phase, and a total volume percent of the tetragonal and hexagonal $Nb_5Si_3$ phases is between about 40 volume percent and about 60 volume percent of the niobium-silicide based alloy.

10. The niobium-silicide based alloy of claim 1, wherein the niobium-silicide based alloy is resistant to oxidation at temperatures at about 1300° C.

11. A turbine having at least a turbine component formed from a niobium-silicide based alloy, the niobium-silicide based alloy comprising:

between about 14 atomic percent and about 24 atomic percent titanium (Ti);

between about 11 atomic percent and about 14 atomic percent silicon (Si);

between about 4 atomic percent and about 8 atomic percent chromium (Cr);

between about 2 atomic percent and about 6 atomic percent hafnium (Hf);

between about 0.1 atomic percent and about 4 atomic percent aluminum (Al);

between about 0.5 atomic percent and about 1 atomic percent tin (Sn);

between about 5 atomic percent and about 15 atomic percent tantalum (Ta);

between about 1 atomic percent and about 5 atomic percent tungsten (W);

between about 0.1 atomic percent and about 5 atomic percent rhenium (Re);

between about 0.1 atomic percent and about 5 atomic percent zirconium (Zr);

between about 0.1 atomic percent and about 6 atomic percent yttrium (Y); and a balance of niobium (Nb).

12. The turbine of claim 11, wherein a sum of the atomic percent of zirconium (Zr) and the atomic percent of yttrium (Y) present in the niobium-silicide based alloy is between about 0.2 atomic percent and about 11 atomic percent.

13. The turbine of claim 11, wherein the niobium-silicide based alloy further includes a tetragonal $Nb_5Si_3$ phase comprising at least 40 volume percent of the niobium-silicide based alloy.

14. The turbine of claim 11, wherein the turbine component is one or more of a blade, a rotor, or a nozzle.

15. The turbine of claim 11, wherein the turbine is selected from the group consisting of land-based turbines, marine turbines, aeronautical turbines, and power generation turbines.

16. The niobium-silicide based alloy of claim 1, wherein a sum of the atomic percent of tantalum (Ta) and the atomic percent of tungsten (W) present in the niobium-silicide based alloy is between greater than 5 atomic percent and about 20 atomic percent.

17. The turbine of claim 11, wherein a sum of the atomic percent of tantalum (Ta) and the atomic percent of tungsten (W) present in the niobium-silicide based alloy is between greater than 5 atomic percent and about 20 atomic percent.

* * * * *